US007538732B2

(12) United States Patent
Ishihara et al.

(10) Patent No.: US 7,538,732 B2
(45) Date of Patent: May 26, 2009

(54) ANTENNA STRUCTURE AND RADIO COMMUNICATION APPARATUS INCLUDING THE SAME

(75) Inventors: Takashi Ishihara, Machida (JP); Kengo Onaka, Yokohama (JP); Shoji Nagumo, Sagamihara (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 120 days.

(21) Appl. No.: 11/772,380

(22) Filed: Jul. 2, 2007

(65) Prior Publication Data

US 2008/0122714 A1 May 29, 2008

Related U.S. Application Data

(63) Continuation of application No. PCT/JP2005/022100, filed on Dec. 1, 2005.

(30) Foreign Application Priority Data

Jan. 5, 2005 (JP) ..... 2005-000773

(51) Int. Cl.
*H01Q 1/24* (2006.01)

(52) U.S. Cl. ..... 343/702; 343/700 MS

(58) Field of Classification Search ..... 343/700 MS, 343/702, 895
See application file for complete search history.

(56) References Cited

U.S. PATENT DOCUMENTS

| | | | | |
|---|---|---|---|---|
| 6,177,908 | B1 * | 1/2001 | Kawahata et al. | 343/700 MS |
| 6,657,593 | B2 * | 12/2003 | Nagumo et al. | 343/700 MS |
| 6,950,072 | B2 | 9/2005 | Miyata et al. | |
| 7,136,020 | B2 * | 11/2006 | Yamaki | 343/702 |
| 2001/0048390 | A1 | 12/2001 | Nagumo et al. | |
| 2002/0030626 | A1 | 3/2002 | Nagumo et al. | |

(Continued)

FOREIGN PATENT DOCUMENTS

| | | |
|---|---|---|
| EP | 0 938 158 | 8/1999 |

(Continued)

OTHER PUBLICATIONS

PCT/JP2005/022100, Written Opinion (with English translation) dated Feb. 14, 2006.

(Continued)

*Primary Examiner*—Tan Ho
(74) *Attorney, Agent, or Firm*—Dickstein Shapiro LLP

(57) ABSTRACT

In an antenna structure 1 in which a feed radiation electrode provided on a dielectric base member performs an antenna operation in a fundamental mode and an antenna operation in a higher-order mode with a resonant frequency higher than that in the fundamental mode, one end of the feed radiation electrode defines a feed end connected to a circuit for radio communication, and the other end of the feed radiation electrode defines an open end. The position of a capacitance-loading portion α is set in advance between the feed end and the open end of the feed radiation electrode. A capacitance-loading conductor is connected to one or both of the feed end and the capacitance-loading portion α of the feed radiation electrode. The capacitance-loading conductor forms a capacitance for adjusting a resonant frequency in the fundamental mode between the feed end and the capacitance-loading portion α.

33 Claims, 6 Drawing Sheets

U.S. PATENT DOCUMENTS

| | | | | |
|---|---|---|---|---|
| 2002/0075190 | A1 | 6/2002 | Ghosh et al. | |
| 2002/0196192 | A1 | 12/2002 | Nagumo et al. | |
| 2007/0257850 | A1 * | 11/2007 | Onaka et al. | 343/702 |

FOREIGN PATENT DOCUMENTS

| | | | |
|---|---|---|---|
| EP | 1 122 812 | A2 | 8/2001 |
| EP | 1 146 590 | A2 | 10/2001 |
| JP | 2001-217631 | | 8/2001 |
| JP | 2004-166242 | | 6/2004 |
| JP | 2004-201281 | | 7/2004 |
| JP | 2005-117082 | | 4/2005 |

OTHER PUBLICATIONS

PCT/JP2005/022100, International Search Report dated Feb. 14, 2006.

* cited by examiner

ANTENNA STRUCTURE AND RADIO COMMUNICATION APPARATUS INCLUDING THE SAME

CROSS REFERENCE TO RELATED APPLICATIONS

The present application is a continuation of International Application No. PCT/JP2005/022100, filed Dec. 1, 2005, which claims priority to Japanese Patent Application No. JP2005-000773, filed Jan. 5, 2005, the entire contents of each of these applications being incorporated herein by reference in their entirety.

FIELD OF THE INVENTION

The present invention relates to an antenna structure provided in a radio communication apparatus, such as a portable telephone, and a radio communication apparatus including the antenna structure.

BACKGROUND OF THE INVENTION

In recent years, attention has been paid to multiband antennas configured such that a single antenna is capable of performing radio wave communication in a plurality of frequency bands. For example, since a radiation electrode performing an antenna operation has a plurality of resonant modes with different resonant frequencies, multiband antennas that are capable of performing radio wave communication in a plurality of frequency bands utilizing a plurality of resonant modes of the radiation electrode have been available.

See Japanese Unexamined Patent Application Publication No. 2004-166242

In general, a multiband antenna utilizing a plurality of resonant modes of a radiation electrode uses a resonance in a fundamental mode with the lowest frequency among the plurality of resonant modes of the radiation electrode and a resonance in a higher-order mode with a frequency higher than that in the fundamental mode. Thus, the radiation electrode is designed such that the resonance in the fundamental mode of the radiation electrode occurs in a lower frequency band among a plurality of frequency bands set for radio wave communication and that the resonance in the higher-order mode of the radiation electrode occurs in a higher frequency band of the settings for radio wave communication.

However, for example, in a miniaturized antenna, due to the constraints of size, it is difficult to separately control the resonant frequency in the fundamental mode of the radiation electrode and the resonant frequency in the higher-order mode of the radiation electrode. Thus, for example, even if the resonant frequency in the fundamental mode can be adjusted to a value that approximately satisfies a request, the resonant frequency in the higher-order mode deviates from an acceptable value. Thus, it has been difficult to form a radiation electrode in which both the resonant frequency in the fundamental mode and the resonant frequency in the higher-order mode can be adjusted to acceptable values.

SUMMARY OF THE INVENTION

In the present invention, the configurations given below serve as means for solving these problems. That is, in an antenna structure according to the present invention, a feed radiation electrode is connected to a circuit for radio communication and is three-dimensionally provided inside or on a surface of a dielectric base member. The feed radiation electrode performs an antenna operation in a fundamental mode with the lowest resonant frequency among a plurality of resonant frequencies of the electrode and an antenna operation in a higher-order mode with a resonant frequency higher than the resonant frequency in the fundamental mode.

The feed radiation electrode has a spiral shape in which the feed radiation electrode extends in a direction away from a feed point connected to the circuit for radio communication and then turns to approach the feed point. One end of the feed radiation electrode defines a feed end connected via the feed point to the circuit for radio communication, and a spiral end, which is the other end of the feed radiation electrode, defines an open end.

A ground-level voltage region in the higher-order mode located closer to the open end with respect to the feed end of the feed radiation electrode is set in advance as a capacitance-loading portion. A capacitance-loading conductor is provided in and extends from the capacitance-loading portion in a direction approaching the feed end and forms a capacitance for adjusting the resonant frequency in the fundamental mode between the feed end of the feed radiation electrode and the capacitance-loading portion.

In addition, in an antenna structure according to a further modification of the present invention, the position of a capacitance-loading portion is set in advance in a feed radiation electrode portion between the feed end and the open end, and a capacitance-loading conductor that extends from the feed end in a direction approaching the capacitance-loading portion and that forms a capacitance for adjusting the resonant frequency in the fundamental mode between the feed end of the feed radiation electrode and the capacitance-loading portion is provided at the feed end of the feed radiation electrode.

In addition, in an antenna structure according to yet another modification of the present invention, a capacitance-loading conductor that extends from a capacitance-loading portion toward the feed end is provided in the capacitance-loading portion set in advance in a feed radiation electrode portion between the feed end and the open end, another capacitance-loading conductor that extends from the feed end toward the capacitance-loading portion is provided at the feed end of the feed radiation electrode, and a capacitance for adjusting the resonant frequency in the fundamental mode is formed between the capacitance-loading conductor provided in the capacitance-loading portion and the capacitance-loading conductor provided at the feed end.

In addition, in an antenna structure according to the present invention in which a feed radiation electrode connected to a circuit for radio communication is three-dimensionally provided inside or on a surface of a dielectric base member, a non-feed radiation electrode that is provided with a space between the non-feed radiation electrode and the feed radiation electrode and that is electromagnetically coupled to the feed radiation electrode to produce a multiple-resonance state is provided inside or on the surface of the dielectric base member, and the non-feed radiation electrode is configured to perform an antenna operation in a fundamental mode with the lowest resonant frequency among a plurality of resonant frequencies of the electrode and an antenna operation in a higher-order mode with a resonant frequency higher than the resonant frequency in the fundamental mode.

The non-feed radiation electrode has a spiral shape in which the non-feed radiation electrode extends in a direction away from a conduction point connected to a ground and then turns to approach the conduction point. One end of the non-feed radiation electrode defines a short end grounded via the conduction point to the ground, and a spiral end, which is the other end of the non-feed radiation electrode, defines an open end.

A capacitance-loading portion set in advance in a non-feed radiation electrode portion between the short end and the open end, a capacitance-loading conductor that extends from the capacitance-loading portion in a direction approaching the short end and that forms a capacitance for adjusting the resonant frequency in the fundamental mode between the short end of the non-feed radiation electrode and the capacitance-loading portion is provided.

In addition, in an antenna structure according to the present invention in which a feed radiation electrode connected to a circuit for radio communication is three-dimensionally provided inside or on a surface of a dielectric base member, a non-feed radiation electrode that is provided with a space between the non-feed radiation electrode and the feed radiation electrode and that is electromagnetically coupled to the feed radiation electrode to produce a multiple-resonance state is provided inside or on the surface of the dielectric base member. The non-feed radiation electrode is configured to perform an antenna operation in a fundamental mode with the lowest resonant frequency among a plurality of resonant frequencies of the electrode and an antenna operation in a higher-order mode with a resonant frequency higher than the resonant frequency in the fundamental mode.

The non-feed radiation electrode has a spiral shape in which the non-feed radiation electrode extends in a direction away from a conduction point connected to a ground and then turns to approach the conduction point. One end of the non-feed radiation electrode defines a short end grounded via the conduction point to the ground, and a spiral end, which is the other end of the non-feed radiation electrode, defines an open end.

The position of a capacitance-loading portion is set in advance in a non-feed radiation electrode portion between the short end and the open end. A capacitance-loading conductor extends from the short end in a direction approaching the capacitance-loading portion and forms a capacitance for adjusting the resonant frequency in the fundamental mode between the short end of the non-feed radiation electrode and the capacitance-loading portion is provided at the short end of the non-feed radiation electrode.

In addition, in an antenna structure according to the present invention in which a feed radiation electrode connected to a circuit for radio communication is three-dimensionally provided inside or on a surface of a dielectric base member, a non-feed radiation electrode is provided with a space between the non-feed radiation electrode and the feed radiation electrode and is electromagnetically coupled to the feed radiation electrode to produce a multiple-resonance state is provided inside or on the surface of the dielectric base member. The non-feed radiation electrode is configured to perform an antenna operation in a fundamental mode with the lowest resonant frequency among a plurality of resonant frequencies of the electrode and an antenna operation in a higher-order mode with a resonant frequency higher than the resonant frequency in the fundamental mode.

The non-feed radiation electrode has a spiral shape in which the non-feed radiation electrode extends in a direction away from a conduction point connected to a ground and then turns to approach the conduction point. One end of the non-feed radiation electrode defines a short end grounded via the conduction point to the ground, and a spiral end, which is the other end of the non-feed radiation electrode, defines an open end.

A capacitance-loading conductor extends from a capacitance-loading portion toward the short end and is provided in the capacitance-loading portion set in advance in a non-feed radiation electrode portion between the short end and the open end. An other capacitance-loading conductor extends from the short end toward the capacitance-loading portion and is provided at the short end of the non-feed radiation electrode. A capacitance for adjusting the resonant frequency in the fundamental mode is formed between the capacitance-loading conductor provided at the short end and the capacitance-loading conductor provided in the capacitance-loading portion.

In addition, a radio communication apparatus according to the present invention includes an antenna structure described above.

According to the present invention, in a feed-radiation electrode, a capacitance-loading conductor is connected to one or both of a feed end and a capacitance-loading portion set in advance. The capacitance-loading conductor extends from one of the feed end of the feed radiation electrode and the capacitance-loading portion toward the other one of the feed end of the feed radiation electrode and the capacitance-loading portion and forms a capacitance for adjusting a resonant frequency in a fundamental mode between the feed end of the feed-radiation electrode and the capacitance-loading portion.

For example, by setting a ground-level voltage region located closer to an open end with respect to the feed end of the feed-radiation electrode and having a voltage level in a higher-order mode that is nearest to a ground level as a capacitance-loading portion, the advantages given below can be achieved. That is, for the higher-order mode, the ground-level voltage region in the higher-order mode of the feed radiation electrode is a region in which a voltage level that is equal to the ground level or that is nearest to the ground level is achieved. In contrast, for the fundamental mode, the ground-level voltage region in the higher-order mode is a region closer to a maximum voltage region. Thus, for the fundamental mode, the voltage difference between the feed end of the feed radiation electrode and the ground-level voltage region in the higher mode is large, and the capacitance between the feed end and the ground-level voltage region is large. Thus, the capacitance between the feed end and the ground-level voltage region in the higher-order mode greatly affects the resonant frequency in the fundamental mode. In contrast, for the higher-order mode, the voltage difference between the feed end of the feed radiation electrode and the ground-level voltage region in the higher-order mode is small, and the capacitance between the feed end and the ground-level voltage region is small. Thus, the capacitance between the feed end and the ground-level voltage region hardly affects the resonant frequency in the higher-order mode.

That is, by adjusting the capacitance between the feed end of the feed radiation electrode and the ground-level voltage region (the capacitance-loading portion) in the higher-order mode, the resonant frequency in the fundamental mode can be adjusted with almost no change in the resonant frequency in the higher-order mode. In addition, a capacitance-loading conductor used in the present invention is provided only for adjusting the capacitance between the feed end of the feed radiation electrode and the capacitance-loading portion (the ground-level voltage region), and the capacitance-loading conductor does not perform an antenna operation together with the feed radiation electrode. Thus, the capacitance-loading conductor can be designed with high flexibility.

Thus, for example, the feed radiation electrode is designed with consideration of the electrical length and the like of the feed radiation electrode such that the resonant frequency in the higher-order mode of the feed radiation electrode is adjusted to a set value set in advance. In addition, the capacitance-loading conductor is designed such that the resonant frequency in the fundamental mode of the feed radiation electrode is adjusted to a set value set in advance. By designing the feed radiation electrode and the capacitance-loading conductor as described above, the resonant frequency in the fundamental mode of the feed radiation electrode and the resonant frequency in the higher-order mode of the feed radiation electrode can be adjusted individually. Thus, it is easier to cause the feed radiation electrode to perform resonant operations at the set resonant frequencies in both the fundamental mode and the higher-order mode.

In the configuration in which a non-feed radiation electrode is provided with a capacitance-loading conductor, similarly to the above description, by using the capacitance-loading conductor, the resonant frequency in the fundamental mode can be adjusted with almost no change in the resonant frequency in the higher-order mode of the non-feed radiation electrode. Thus, similarly to the feed radiation electrode, it is easier to cause the non-feed radiation electrode to perform resonant operations at the set resonant frequencies both in the fundamental mode and the higher-order mode.

In addition, according to the present invention, in order to reduce the resonant frequency in the fundamental mode of the feed radiation electrode or the non-feed radiation electrode, the capacitance between the feed end (or the short end) and the capacitance-loading portion (for example, the ground-level voltage region in the higher-order mode) is adjusted to be larger by using the capacitance-loading conductor. Accordingly, the resonant frequency in the fundamental mode can be reduced. That is, the resonant frequency in the fundamental mode can be reduced without reducing the electrode width of the feed radiation electrode or the non-feed radiation electrode. If the electrode width is reduced, current concentration occurs. Thus, conductive loss increases. However, in the present invention, the electrode width does not need to be reduced in order to reduce the resonant frequency in the fundamental mode. Thus, current concentration is released, and an increase in the conductive loss can be suppressed.

In addition, in the present invention, since a capacitance-loading conductor is provided, a higher capacitance is achieved between the feed end (or the short end) of the feed or non-feed radiation electrode and the capacitance-loading portion (for example, the ground-level voltage region in the higher-order mode), compared with a case where the capacitance-loading conductor is not provided. Thus, the capacitance formed between the ground, and the feed end (or the short end) of the feed or non-feed radiation electrode and the capacitance-loading portion is reduced. That is, since electromagnetic coupling between the ground, and the feed end (or the short end) of the feed or non-feed radiation electrode and the capacitance-loading portion is weak, the Q-value of the radiation electrode is reduced. Thus, the frequency bandwidth for radio communication can be increased.

In addition, electric fields of the feed and non-feed radiation electrodes are likely to be attracted to the ground. Thus, if an object (for example, a human finger or the like) regarded as a ground is near or away from a radiation electrode, a radiation state of the electric field is likely to change. However, in the present invention, due to the provision of a capacitance-loading conductor, the capacitance between the feed end (or the short end) of the radiation electrode and the capacitance-loading portion increases to achieve strong electric field coupling. Thus, since the electric field amount attracted to the ground can be reduced, the change in the radiation state of the electric field caused by, for example, a human hand placed near the radiation electrode can be suppressed.

Due to an increase in the bandwidth, suppression of the increase in conductive loss, and prevention of the change in electric field radiation due to a change of ambient surroundings of an antenna, an antenna structure according to the present invention and a radio communication apparatus including the antenna structure are capable of improving the antenna characteristics.

In addition, in the present invention, at least one of feed and non-feed radiation electrodes has a simple configuration in which a capacitance-loading conductor is connected to one or both of a feed end (or a short end) and a capacitance-loading portion. With such a simple configuration, the above-mentioned excellent advantages can be achieved.

REFERENCE NUMERALS

Figure 1A:
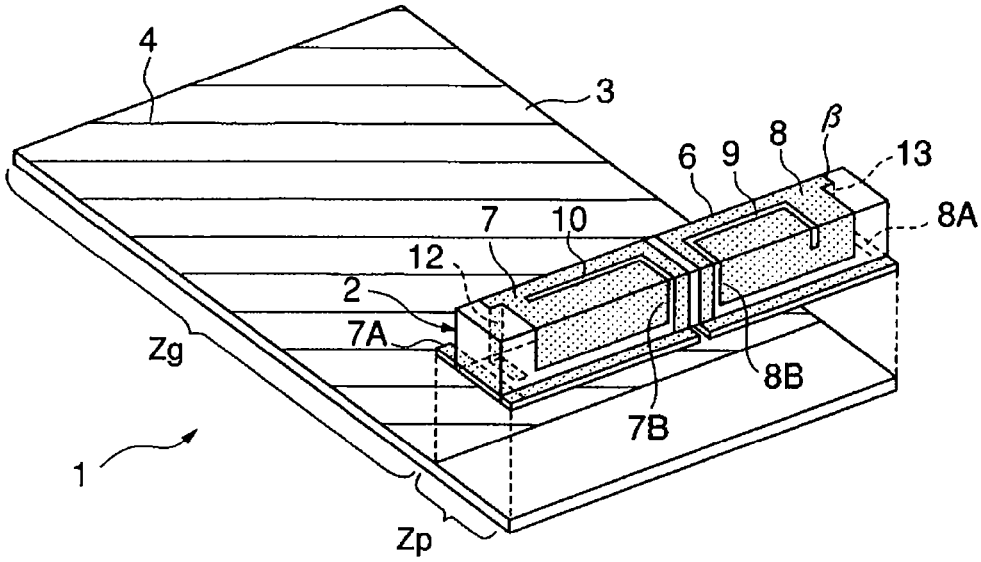
FIG. 1*a* is an illustration for explaining an antenna structure according to a first embodiment.

1 antenna structure
3 circuit board

4 ground
6 dielectric base member
7 feed radiation electrode
8 non-feed radiation electrode
12, 13, 14 capacitance-loading conductor

DETAILED DESCRIPTION OF THE INVENTION

Embodiments of the present invention will now be described with reference to the drawings.

FIG. 1*a* is an exploded view schematically showing an antenna structure according to a first embodiment. The antenna structure 1 according to the first embodiment includes an antenna 2. The antenna 2 is provided in a non-ground region Zp of a circuit board 3 of a radio communication apparatus (for example, a portable telephone). That is, in the circuit board 3, the non-ground region Zp in which a ground is not formed is disposed on one end, and a ground region Zg in which a ground 4 is formed is disposed next to the non-ground region Zp. The antenna 2 is surface-mounted in the non-ground region Zp of the circuit board 3.

The antenna 2 includes a dielectric base member 6 of a rectangular-parallelepiped shape. The antenna 2 also includes a feed radiation electrode 7 and a non-feed radiation electrode 8 that are provided on the dielectric base member 6. The dielectric base member 6 is formed of resin materials including a material for improving the dielectric constant. Metal plates forming the feed radiation electrode 7 and the non-feed radiation electrode 8 are provided on the dielectric base member 6 by insert molding.

A slit 10 is formed in the metal plate of the feed radiation electrode 7, and the feed radiation electrode 7 is shaped by bending the metal plate. The feed radiation electrode 7 has a shape in which a current path in a fundamental mode of the feed radiation electrode 7, shown by a solid line I in an enlarged view of FIG. 1*b*, has a spiral shape. In other words, the feed radiation electrode 7 has a spiral shape in which the feed radiation electrode 7 extends in a direction away from a feed point (7A) connected to a high-frequency circuit 11 for radio communication of a radio communication apparatus and then turns to approach toward the feed point. One end 7A of the feed radiation electrode 7 defines a feed end connected via the feed point to the high-frequency circuit 11 for radio communication, and the spiral end, which is the other end 7B of the feed radiation electrode 7, defines an open end. In this specification, the spiral shape is not limited to a round shape. The spiral shape may be a square spiral or the like other than the round shape.

Figure 2A:
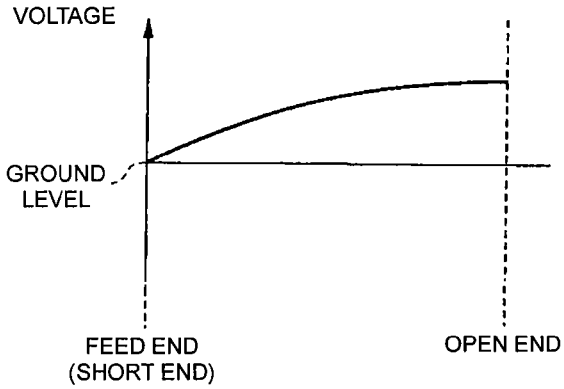
FIG. 2*a* is a graph showing an example of voltage distribution in a fundamental mode of a radiation electrode.
Figure 2B:
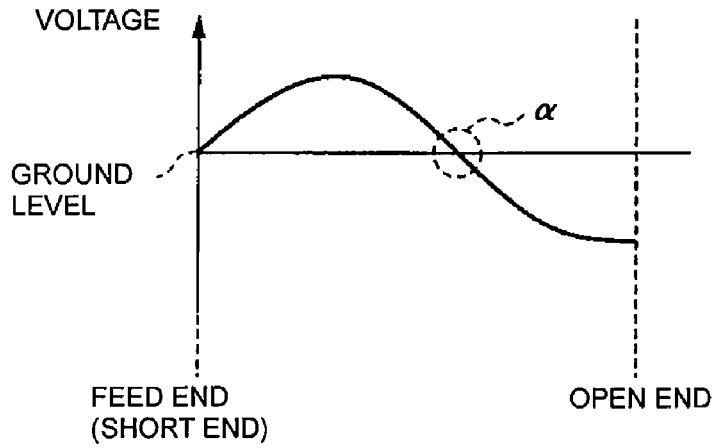
FIG. 2*b* is a graph showing an example of voltage distribution in a higher-order mode of the radiation electrode.

In the first embodiment, the feed radiation electrode 7 is configured to perform an antenna operation in a fundamental mode with the lowest resonant frequency among a plurality of resonant frequencies of the feed radiation electrode 7 and an antenna operation in a higher-order mode (for example, a third-order mode) with a resonant frequency higher than that in the fundamental mode. FIG. 2*a* shows voltage distribution in the fundamental mode of the feed radiation electrode 7. FIG. 2*b* shows voltage distribution in the higher-order mode (for example, the third-order mode).

In the first embodiment, an electrical length (that is, an electrical length from the feed end 7A to the open end 7B of the feed radiation electrode 7) for adjusting the resonant frequency in the higher-order mode (for example, the third-order mode) of the feed radiation electrode 7 to a resonant frequency set in advance (in other words, for producing a resonance in a frequency band assigned in advance higher than that in the fundamental mode) is calculated in advance, and the slit length of the slit 10, the electrode width, and the like of the feed radiation electrode 7 are designed to achieve this electrical length.

In addition, in the feed radiation electrode 7, a ground-level voltage region (see regions surrounded by dotted lines a in FIGS. 1*b* and 2), which is a portion electrically closer to the open end 7B with respect to the feed end 7A and which has a voltage level in the higher-order mode that is equal to a ground level or that is nearest to the ground level, is set in advance as a capacitance-loading portion. A capacitance-loading conductor 12 is connected to the capacitance-loading portion. The capacitance-loading conductor 12 extends from the ground-level voltage region (the capacitance-loading portion) α of the feed radiation electrode 7 toward the feed end while penetrating inside the dielectric base member 6. The capacitance-loading conductor 12 is provided in order to increase the capacitance between the feed end 7A of the feed radiation electrode 7 and the ground-level voltage region (the capacitance-loading portion) α in the higher-order mode. The capacitance between the feed end 7A of the feed radiation electrode 7 and the ground-level voltage region α in the higher-order mode defines a fundamental-mode resonant frequency adjustment capacitance for adjusting the resonant frequency in the fundamental mode of the feed radiation electrode 7 to a set value.

The non-feed radiation electrode 8 is disposed with a space between the non-feed radiation electrode 8 and the feed radiation electrode 7 and is electromagnetically coupled to the feed radiation electrode 7 to produce a multiple-resonance state. In the first embodiment, the non-feed radiation electrode 8 has a configuration approximately similar to that of the feed radiation electrode 7. That is, the non-feed radiation electrode 8 has a spiral shape in which the non-feed radiation electrode 8 extends in a direction away from a conduction point connected to the ground 4 of the circuit board 3 and then turns to approach the conduction point, and a current path in the fundamental mode of the non-feed radiation electrode 8 has a spiral shape. One end 8A of the non-feed radiation electrode 8 defines a short end grounded via the conduction point to the ground 4, and the spiral end, which is the other end 8B of the non-feed radiation electrode 8, defines an open end. Similar to the feed radiation electrode 7, the non-feed radiation electrode 8 performs an antenna operation in the fundamental mode and an antenna operation in the higher-order mode. Current distribution in each of the fundamental mode and the higher-order mode of the non-feed radiation electrode 8 is similar to current distribution in each of the fundamental mode and the higher-order mode of the feed radiation electrode 7.

In the first embodiment, an electrical length (for example, an electrical length from the short end 8A to the open end 8B of the non-feed radiation electrode 8) for adjusting the resonant frequency in the higher-order mode (for example, the third-order mode) of the non-feed radiation electrode 8 to a resonant frequency set in advance is calculated in advance, and the slit length of a slit 9, the electrode width, and the like of the non-feed radiation electrode 8 are designed so as to achieve the electrical length.

In addition, a ground-level voltage region β, which has a voltage level in the higher-order mode of the non-feed radiation electrode 8 that is equal to a ground level or that is nearest to the ground level, is set in advance as a capacitance-loading portion. A capacitance-loading conductor 13 is connected to the capacitance-loading portion. The capacitance-loading conductor 13 has a shape similar to that of the capacitance-loading conductor 12 connected to the feed radiation electrode 7. That is, the capacitance-loading conductor 13 extends toward the short end 8A of the non-feed radiation electrode 8 while penetrating inside the dielectric base member 6. The capacitance-loading conductor 13 increases the capacitance between the short end 8A of the non-feed radiation electrode 8 and the ground-level voltage region (the capacitance-loading portion) β in the higher-order mode. The capacitance between the short end 8A of the non-feed radiation electrode 8 and the ground-level voltage region (the capacitance-loading portion) β defines a fundamental-mode resonant frequency adjustment capacitance for adjusting the resonant frequency in the fundamental mode of the non-feed radiation electrode 8 to a value set in advance.

The antenna structure according to the first embodiment is configured as described above. In the first embodiment, the feed radiation electrode 7 and the non-feed radiation electrode 8 are provided with the capacitance-loading conductors 12 and 13, respectively. Thus, by using each of the capacitance-loading conductors 12 and 13, the capacitance between the feed end (short end) of each of the feed radiation electrode 7 and the non-feed radiation electrode 8 and the ground-level voltage region (the capacitance-loading portion) in the higher-order mode can be adjusted easily. With this configuration, by adjusting the capacitances, the resonance frequencies in the fundamental mode of the feed radiation electrode 7 and the non-feed radiation electrode 8 can be adjusted easily with almost no change in the resonant frequencies in the higher-order mode of the feed radiation electrode 7 and the non-feed radiation electrode 8.

Figure 3:
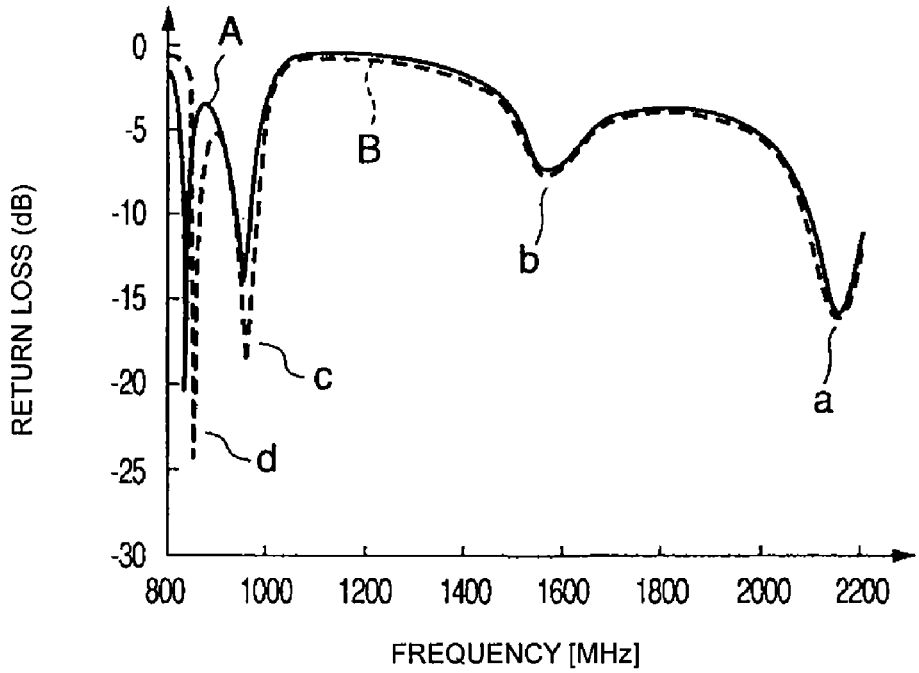
FIG. 3 is a graph showing an example of return loss characteristics of the antenna structure shown in FIG. 1*a*.

This is verified by experiments performed by the inventors. Experimental results are shown in the graph of FIG. 3. A solid line A in FIG. 3 represents the antenna structure 1 including the capacitance-loading conductor 13, which is characteristic in the first embodiment. A dotted line B in FIG. 3 represents an antenna structure having a configuration similar to that of the antenna structure 1 according to the first embodiment with the exception that the capacitance-loading conductor 13 is not provided. In addition, a sign a in the graph represents a frequency band in the higher-order mode of the feed radiation electrode 7, a sign b represents a frequency band in the higher-order mode of the non-feed radiation electrode 8, a sign c represents a frequency band in the fundamental mode of the feed radiation electrode 7, and a sign d represents a frequency band in the fundamental mode of the non-feed radiation electrode 8.

As is clear from the comparison between the solid line A and the dotted line B in FIG. 3, due to an increase in the capacitance between the short end of the non-feed radiation electrode 8 and the ground-level voltage region (the capacitance-loading portion) β in the higher-order mode caused by provision of the capacitance-loading conductor 13, the resonant frequency in the fundamental mode d of the non-feed radiation electrode 8 can be adjusted to be lower without changing the resonant frequency in the higher-order mode a of the feed radiation electrode 7 and the resonant frequency in the higher-order mode b of the non-feed radiation electrode 8.

Figure 4A:
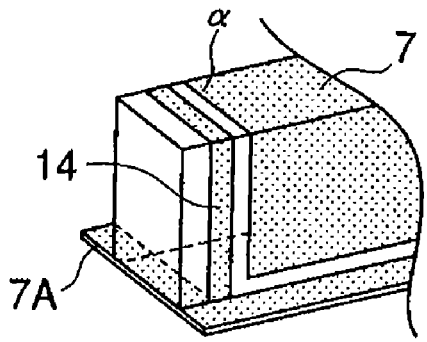
FIG. 4*a* is a model diagram showing another configuration example of the feed radiation electrode.

In the first embodiment, the capacitance-loading conductor 12 is connected to the ground-level voltage region α in the higher-order mode of the feed radiation electrode 7, and the capacitance-loading conductor 13 is connected to the ground-level voltage region β in the higher-order mode of the non-feed radiation electrode 8. In addition, the capacitance-loading conductors 12 and 13 extend toward the feed end of the feed radiation electrode 7 and the short end of the non-feed radiation electrode 8. A capacitance-loading conductor only needs to increase the capacitance between the ground-level voltage region (the capacitance-loading portion) α or β in the higher-order mode of the feed radiation electrode 7 or the non-feed radiation electrode 8 and the feed end (or the short end). Thus, for example, as shown in FIG. 4*a*, a capacitance-loading conductor 14 may be connected to the feed end 7A of the feed radiation electrode 7, and the capacitance-loading conductor 14 may extend toward the ground-level voltage region α in the higher-order mode of the feed radiation electrode 7. Similarly, a capacitance-loading conductor may be connected to the short end of the non-feed radiation electrode 8, and the capacitance-loading conductor may extend toward the ground-level voltage region β in the higher-order mode of the non-feed radiation electrode 8.

Figure 4B:
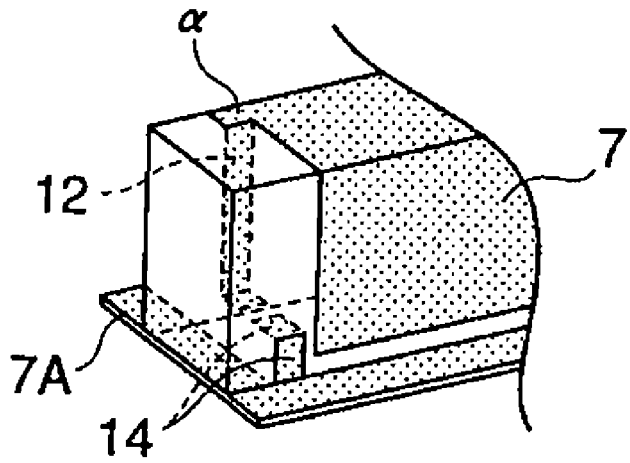
FIG. 4*b* is a model diagram showing still another configuration example of the feed radiation electrode.

In addition, for example, as shown in FIG. 4*b*, the capacitance-loading conductor 12 may be connected to the ground-level voltage region α in the higher-order mode of the feed radiation electrode 7, and the capacitance-loading conductor 14 may be connected to the feed end 7A. The capacitance-loading conductor 12 extends toward the feed end, and the capacitance-loading conductor 14 extends toward the ground-level voltage region α in the higher-order mode of the feed radiation electrode 7. A capacitance is formed between the capacitance-loading conductors 12 and 14. This capacitance is equal to the capacitance formed between the feed end of the feed radiation electrode 7 and the ground-level voltage region α in the higher-order mode, and the capacitance defines a fundamental-mode resonant frequency adjustment capacitance. In addition, for the non-feed radiation electrode 8, similarly, a capacitance-loading conductor may be connected to the ground-level voltage region β in the higher-order mode of the non-feed radiation electrode 8, and a capacitance-loading conductor may be connected to the short end. In addition, the capacitance-loading conductors extend in a direction approaching each other. The capacitance-loading conductors form a fundamental-mode resonant frequency adjustment capacitance between the short end of the non-feed radiation electrode 8 and the ground-level voltage region β in the higher-order mode.

Figure 1B:
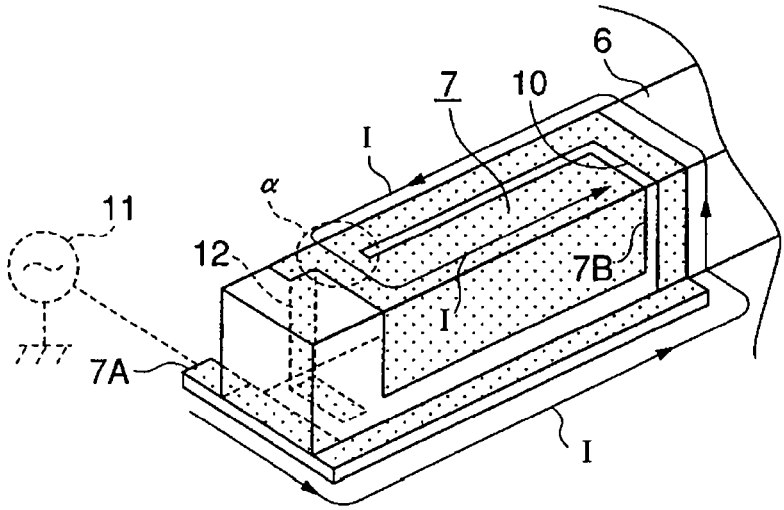
FIG. 1*b* is a model diagram for explaining a configuration example of a feed radiation electrode forming the antenna structure according to the first embodiment.
Figure 4C:
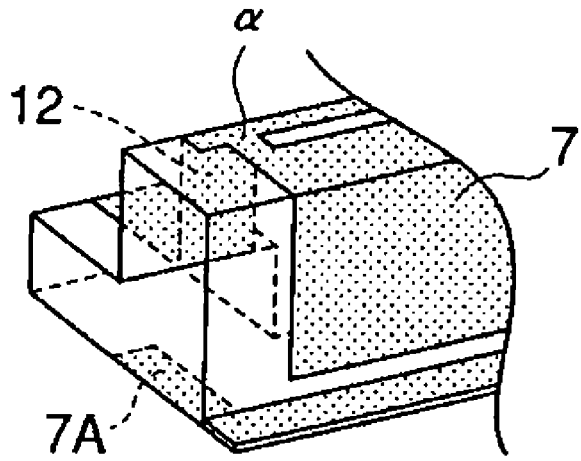
FIG. 4*c* is a model diagram showing still another configuration example of the feed radiation electrode.

In addition, in the example shown in FIG. 1*b*, the capacitance-loading conductor 12 connected to the ground-level voltage region β in the higher-order mode of the feed radiation electrode 7 is embedded in the dielectric base member 6. However, as shown in FIG. 4*c*, the capacitance-loading conductor 12 may not be embedded in the dielectric base member 6. Similarly, the capacitance-loading conductor 13 of the non-feed radiation electrode 8 may not be embedded in the dielectric base member 6. In addition, as shown in FIG. 4*c*, the capacitance-loading conductor 12 may be bent outwards at a position in the middle of extension of the capacitance-loading conductor 12 of the feed radiation electrode 7. In addition, the capacitance-loading conductor 13 of the non-feed radiation electrode 8 may have a similar configuration.

Figure 4D:
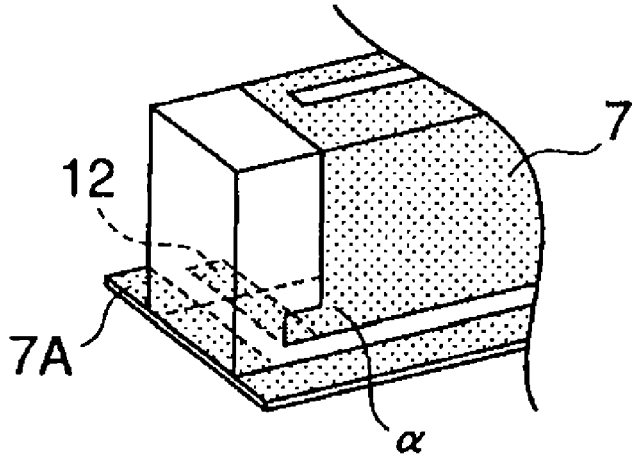
FIG. 4*d* is a model diagram showing still another configuration example of the feed radiation electrode.

In addition, in the examples shown in FIGS. 1*a* and 1*b*, the capacitance-loading conductor 12 is connected to the ground-level voltage region α in the higher-order mode of the feed radiation electrode 7 on the upper surface of the dielectric base member 6. However, the capacitance-loading conductor 12 may be connected anywhere in the ground-level voltage region in the higher-order mode of the feed radiation electrode 7. For example, as shown in FIG. 4*d*, the capacitance-loading conductor 12 may be connected to a feed radiation electrode portion formed on a side surface of the dielectric base member 6 in the ground-level voltage region in the higher-order mode of the feed radiation electrode 7. The same applies to the non-feed radiation electrode 8.

In addition, positions to which capacitance-loading conductors are connected may be different between the feed radiation electrode 7 and the non-feed radiation electrode 8. For example, in the feed radiation electrode 7, the capacitance-loading conductor 12 may be connected to the ground-level voltage region α in the higher-order mode, and in the non-feed radiation electrode 8, a capacitance-loading conductor may be connected to the short end.

Figure 5:
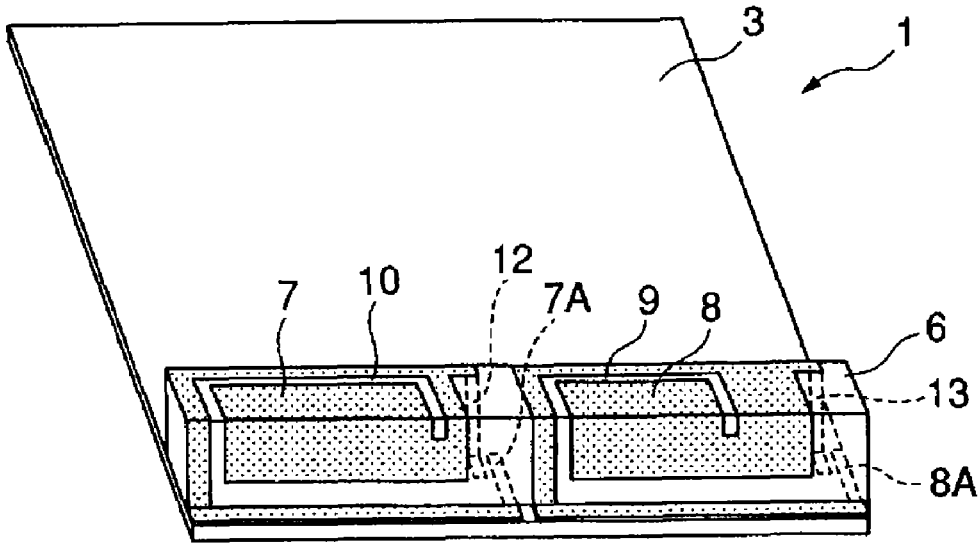
FIG. 5 is a perspective view showing still another configuration example of the feed radiation electrode and a non-feed radiation electrode.

In addition, although the feed radiation electrode 7 and the non-feed radiation electrode 8 have shapes approximately symmetrical to each other in the example shown in FIG. 1*a*, the feed radiation electrode 7 and the non-feed radiation electrode 8 may have the same shapes, as shown in FIG. 5.

Figure 6:
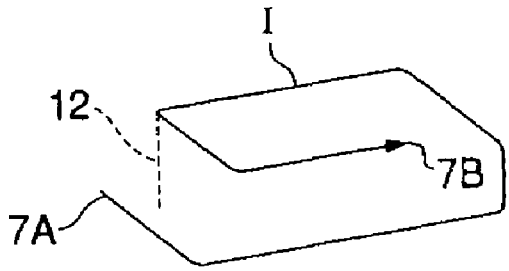
FIG. 6 is an illustration schematically showing a current path in the fundamental mode of the feed radiation electrode shown in FIG. 1*b*.
Figure 7A:
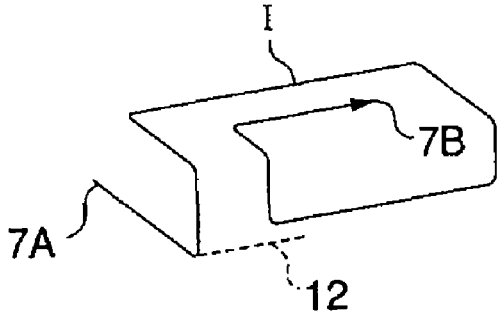
FIG. 7*a* is an illustration schematically showing another example of the current path in the fundamental mode of the feed radiation electrode.
Figure 7B:
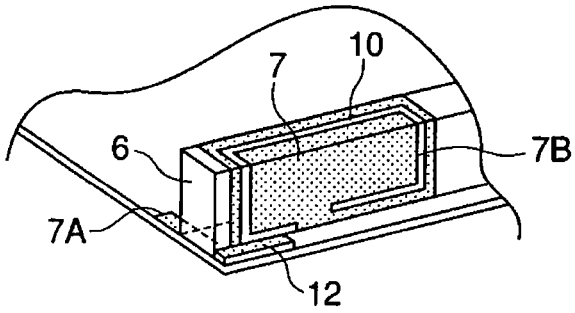
FIG. 7*b* is a model diagram showing a configuration example of the feed radiation electrode in which the current in the fundamental mode is electrically connected by the example of the current path shown in FIG. 7*a*.
Figure 8A:
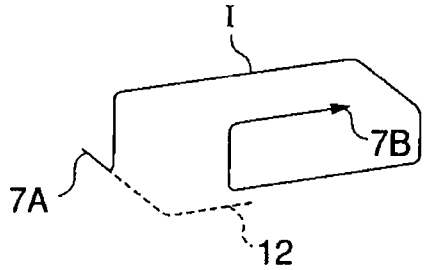
FIG. 8*a* is an illustration schematically showing still another example of the current path in the fundamental mode of the feed radiation electrode.
Figure 8B:
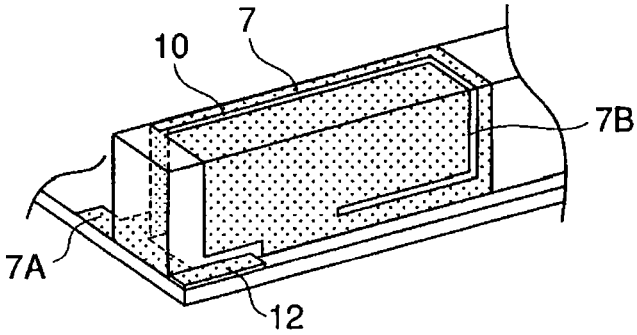
FIG. 8*b* is a model diagram showing a configuration example of the feed radiation electrode in which the current in the fundamental mode is electrically connected by the example of the current path shown in FIG. 8*a*.

In addition, the feed radiation electrode 7 shown in FIGS. 1*a* and 1*b* has a shape in which a current in the fundamental mode flowing in the feed radiation electrode 7 defines a current path I of a spiral shape, as shown in a model diagram of FIG. 6. However, for example, the feed radiation electrode 7 may have a shape (see, for example, FIG. 7*b*) that defines a current path I of a spiral shape, as shown in a model diagram of FIG. 7*a*. Alternatively, the feed radiation electrode 7 may have a shape (see, for example, FIG. 8*b*) that defines a current path I of a spiral shape, as shown in a model diagram of FIG. 8*a*. In addition, the non-feed radiation electrode 8 may have a shape similar to that of the feed radiation electrode 7 shown in FIG. 7*b* or 8*b* or may have a shape symmetrical to that of the feed radiation electrode 7 shown in FIG. 7*b* or 8*b*.

A second embodiment is described next. In the explanations of the second embodiment, the same component parts as in the first embodiment are referred to with the same reference numerals, and the descriptions of those same parts will be omitted here.

Figure 9A:
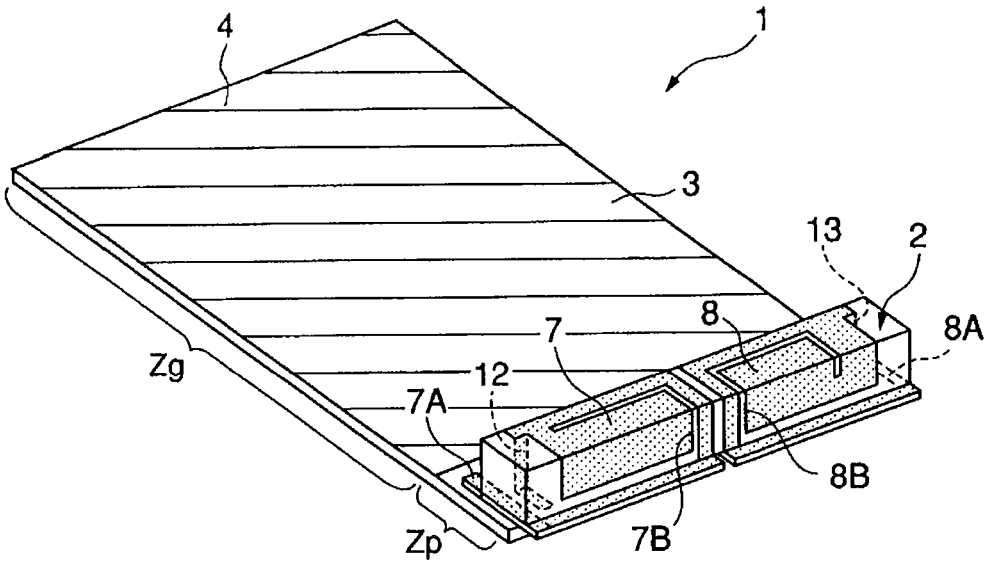
FIG. 9*a* is an illustration for explaining an antenna structure according to a second embodiment.
Figure 9B:
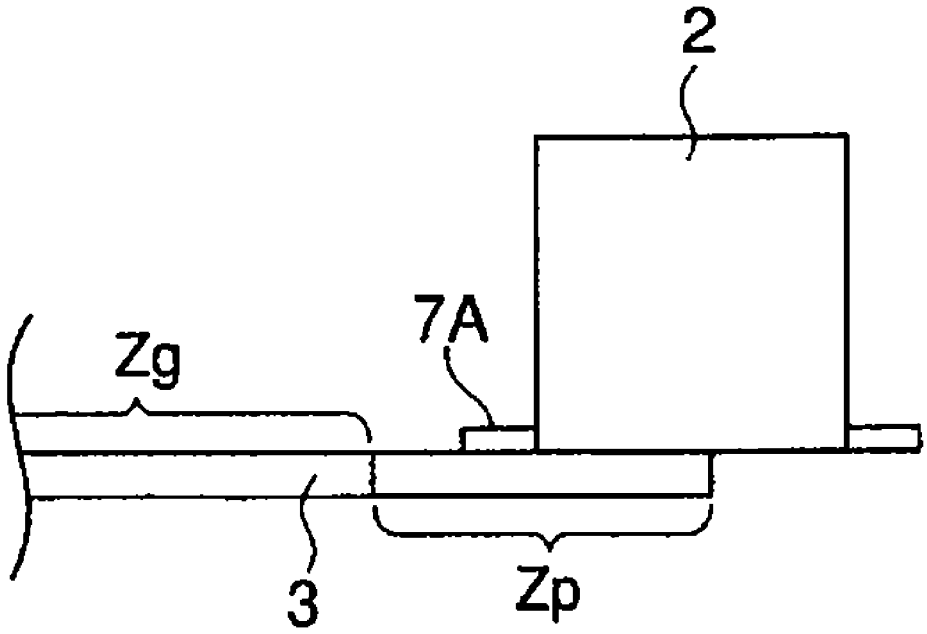
FIG. 9*b* is a model diagram showing a side view of the antenna structure shown in FIG. 9*a*.

In the second embodiment, as shown in a perspective view of FIG. 9*a* and a side view of FIG. 9*b*, the antenna 2 (the feed radiation electrode 7 and the non-feed radiation electrode 8) is provided in the non-ground region Zp of the circuit board 3 such that part of the antenna 2 (the feed radiation electrode 7 and the non-feed radiation electrode 8) protrudes from the non-ground region Zp of the circuit board 3 toward the outside of the board. Apart from this, a configuration similar to that of the first embodiment is provided. In the example shown in FIG. 9*a*, the feed radiation electrode 7 and the non-feed radiation electrode 8 of the antenna 2 has the configuration shown in FIG. 1*a*. However, obviously, the feed radiation electrode 7 and the non-feed radiation electrode 8 may have any of the above-mentioned configurations other than the configuration shown in FIG. 1*a*.

In the second embodiment, the antenna 2 (the feed radiation electrode 7 and the non-feed radiation electrode 8) is provided in the non-ground region Zp of the circuit board 3 such that part of the antenna 2 (the feed radiation electrode 7 and the non-feed radiation electrode 8) protrudes from the non-ground region Zp of the circuit board 3 toward the outside of the board. Thus, compared with a case where the entire feed radiation electrode 7 and the non-feed radiation electrode 8 are provided within the non-ground region Zp, the space between the ground region Zg and each of the feed radiation electrode 7 and the non-feed radiation electrode 8 can be increased. Thus, since a negative effect of ground is reduced, an increase in the frequency bandwidth for radio communication and an improvement in the antenna efficiency can be achieved. Accordingly, a miniaturized and lower-profile antenna structure can be achieved.

A third embodiment is described next. The third embodiment relates to a radio communication apparatus. The radio communication apparatus according to the third embodiment is characterized by including the antenna structure according to the first or second embodiment. As a configuration other than the antenna structure in the radio communication apparatus, there are various possible configurations. Any configuration may be adopted, and the explanation of the configuration is omitted here. In addition, since the antenna structure according to the first or second embodiment has been explained above, the explanation of the antenna structure according to the first or second embodiment is omitted here.

The present invention is not limited to each of the first to third embodiments, and various other embodiments are possible. For example, in each of the first to third embodiments, in addition to the feed radiation electrode 7, the non-feed radiation electrode 8 is provided on the dielectric base member 6. However, for example, if a required frequency bandwidth and a required number of frequency bands can be achieved only by the feed radiation electrode 7, the non-feed radiation electrode 8 may be omitted.

In addition, in each of the first to third embodiments, similarly to the feed radiation electrode 7, the non-feed radiation electrode 8 has a shape in which a current path in the fundamental mode has a spiral shape, and a capacitance-loading conductor for achieving a capacitance for adjusting the resonant frequency in the fundamental mode between the short end and the ground-level voltage region in the higher-order mode is formed. However, for example, if only one of an antenna operation in the fundamental mode of the non-feed radiation electrode 8 and an antenna operation in the higher-order mode of the non-feed radiation electrode 8 is utilized, the resonant frequency can be easily adjusted. Thus, the non-feed radiation electrode 8 may not be provided with a capacitance-loading conductor, which is characteristic in each of the first to third embodiments. In addition, a configuration in which the feed radiation electrode 7 is not provided with a capacitance-loading conductor and in which the non-feed radiation electrode 8 is provided with a capacitance-loading conductor may be provided. In addition, in each of the first to third embodiments, ground-level voltage regions in the higher-order mode of the feed radiation electrode 7 and the non-feed radiation electrode 8 are set as capacitance-loading portions. However, for example, if it is difficult to connect a capacitance-loading conductor to a ground-level voltage region in the higher-order mode due to the constraints in design, a capacitance-loading portion may be set in an appropriate position of a radiation electrode portion between the feed end (or the short end) and the open end.

In addition, in each of the first to third embodiments, a slit is formed in a planer electrode of each of the feed radiation electrode 7 and the non-feed radiation electrode 8 so that a current path in the fundamental mode of each of the radiation electrodes 7 and 8 has a spiral shape. However, for example, in each of the feed radiation electrode 7 and the non-feed radiation electrode 8, a linear or strip-shaped electrode may have a spiral shape.

In addition, in each of the first to third embodiments, the open end of each of the feed radiation electrode 7 and the non-feed radiation electrode 8 is provided on a surface of the dielectric base member 6. However, the open end of each of the feed radiation electrode 7 and the non-feed radiation electrode 8 may be embedded within the dielectric base member 6. As described above, an appropriate portion set in advance of each of the feed radiation electrode 7 and the non-feed radiation electrode 8 may be partially embedded in the dielectric base member 6.

In addition, in each of the first to third embodiments, a single feed radiation electrode 7 and a single non-feed radiation electrode 8 are provided on the dielectric base member 6. However, in accordance with a required frequency bandwidth and a necessary number of frequency bands, a plurality of feed radiation electrodes 7 and a plurality of non-feed radiation electrodes 8 may be provided on the dielectric base member 6.

An antenna structure according to the present invention is capable of performing radio communication in a plurality of frequency bands utilizing a plurality of resonant modes of a radiation electrode. Thus, the antenna structure according to the present invention is effectively provided in a radio communication apparatus performing radio communication in a plurality of frequency bands. In addition, a radio communication apparatus according to the present invention is provided with an antenna structure having a configuration that is characteristic in the present invention, and miniaturization in the antenna structure can be easily achieved. Thus, the radio communication apparatus according to the present invention is suitably applicable to a miniaturized radio communication apparatus.

The invention claimed is:

1. An antenna structure comprising:

a circuit for radio communication;

a dielectric base member;

a feed radiation electrode provided on the dielectric base member and connected to the circuit for radio communication, the feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the feed radiation electrode has a spiral shape such that the feed radiation electrode extends in a direction away from a feed point connected to the circuit for radio communication and then turns to approach the feed point, a first end of the feed radiation electrode defining a feed end connected via the feed point to the circuit for radio communication, and a second end of the feed radiation electrode defining an open end;

a ground-level voltage region in the higher-order mode located electrically proximal to the open end of the feed radiation electrode defining a capacitance-loading portion; and a capacitance-loading conductor that extends from the capacitance-loading portion in a direction toward the feed end, the capacitance-loading conductor forming a capacitance for adjusting the resonant frequency in the fundamental mode between the feed end of the feed radiation electrode and the capacitance-loading portion.

2. An antenna structure according to claim 1, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion located between the short end and the open end of the non-feed radiation electrode; and a capacitance-loading conductor that extends from the capacitance-loading portion in a direction toward the short end, the capacitance-loading conductor forming a capacitance for adjusting the resonant frequency in the fundamental mode between the short end of the non-feed radiation electrode and the capacitance-loading portion.

3. An antenna structure according to claim 1, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion positioned between the short end and the open end of the non-feed radiation electrode; and a capacitance-loading conductor that extends from the short end of the non-feed radiation electrode in a direction toward the capacitance-loading portion, the capacitance-loading conductor forming a capacitance for adjusting the resonant frequency in the fundamental mode between the short end of the non-feed radiation electrode and the capacitance-loading portion.

4. An antenna structure according to claim 1, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance loading portion positioned between the short end and the open end of the non-feed radiation electrode;

a first capacitance-loading conductor that extends from the capacitance-loading portion toward the short end of the non-feed radiation electrode; and a second capacitance-loading conductor that extends from the short end of the non-feed radiation electrode toward the capacitance-loading portion, wherein a capacitance for adjusting the resonant frequency in the fundamental mode is formed between the first capacitance-loading conductor and the second capacitance-loading conductor.

5. The antenna structure according to claim 1, wherein the antenna structure is provided on a board including a ground.

6. The antenna structure according to claim 1, further comprising a board having a ground region and a non-ground region, and at least part of the antenna structure is provided in the non-ground region of the board.

7. The antenna structure according to claim 6, wherein the at least part of the antenna structure protrudes outside the board from the non-ground region.

8. An antenna structure comprising:

a circuit for radio communication;

a dielectric base member;

a feed radiation electrode provided on the dielectric base member and connected to the circuit for radio communication, the feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the feed radiation electrode has a spiral shape such that the feed radiation electrode extends in a direction away from a feed point connected to the circuit for radio communication and then turns to approach the feed point, a first end of the feed radiation electrode defining a feed end connected via the feed point to the circuit for radio communication, and a second end of the feed radiation electrode defining an open end;

a capacitance loading portion positioned between the feed end and the open end; and a capacitance-loading conductor that extends from the feed end in a direction approaching the capacitance-loading portion, the capacitance-loading conductor forming a capacitance for adjusting the resonant frequency in the fundamental mode between the feed end of the feed radiation electrode and the capacitance-loading portion.

9. An antenna structure according to claim 8, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion located between the short end and the open end of the non-feed radiation electrode; and a capacitance-loading conductor that extends from the capacitance-loading portion in a direction toward the short end, the capacitance-loading conductor forming a capacitance for adjusting the resonant frequency in the fundamental mode between the short end of the non-feed radiation electrode and the capacitance-loading portion.

10. An antenna structure according to claim 8, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion positioned between the short end and the open end of the non-feed radiation electrode; and a capacitance-loading conductor that extends from the short end of the non-feed radiation electrode in a direction toward the capacitance-loading portion, the capacitance-loading conductor forming a capacitance for adjusting the resonant frequency in the fundamental mode between the short end of the non-feed radiation electrode and the capacitance-loading portion.

11. An antenna structure according to claim 8, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance loading portion positioned between the short end and the open end of the non-feed radiation electrode;

a first capacitance-loading conductor that extends from the capacitance-loading portion toward the short end of the non-feed radiation electrode; and a second capacitance-loading conductor that extends from the short end of the non-feed radiation electrode toward the capacitance-loading portion, wherein a capacitance for adjusting the resonant frequency in the fundamental mode is formed between the first capacitance-loading conductor and the second capacitance-loading conductor.

12. The antenna structure according to claim 8, wherein the antenna structure is provided on a board including a ground.

13. The antenna structure according to claim 8, further comprising a board having a ground region and a non-ground region, and at least part of the antenna structure is provided in the non-ground region of the board.

14. The antenna structure according to claim 13, wherein the at least part of the antenna structure protrudes outside the board from the non-ground region.

15. An antenna structure comprising:

a circuit for radio communication;

a dielectric base member;

a feed radiation electrode provided on the dielectric base member and connected to the circuit for radio communication, the feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the feed radiation electrode has a spiral shape such that the feed radiation electrode extends in a direction away from a feed point connected to the circuit for radio communication and then turns to approach the feed point, a first end of the feed radiation electrode defining a feed end connected via the feed point to the circuit for radio communication, and a second end of the feed radiation electrode defining an open end;

a capacitance loading portion positioned between the feed end and the open end;

a first capacitance-loading conductor that extends from the capacitance-loading portion toward the feed end; and a second capacitance-loading conductor that extends from the feed end toward the capacitance-loading portion, wherein a capacitance for adjusting the resonant frequency in the fundamental mode is formed between the first capacitance-loading conductor and the second capacitance-loading conductor.

16. An antenna structure according to claim 15, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion located between the short end and the open end of the non-feed radiation electrode; and a capacitance-loading conductor that extends from the capacitance-loading portion in a direction toward the short end, the capacitance-loading conductor forming a capacitance for adjusting the resonant frequency in the fundamental mode between the short end of the non-feed radiation electrode and the capacitance-loading portion.

17. An antenna structure according to claim 15, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion positioned between the short end and the open end of the non-feed radiation electrode; and a capacitance-loading conductor that extends from the short end of the non-feed radiation electrode in a direction toward the capacitance-loading portion, the capacitance-loading conductor forming a capacitance for adjusting the resonant frequency in the fundamental mode between the short end of the non-feed radiation electrode and the capacitance-loading portion.

18. An antenna structure according to claim 15, further comprising:

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance loading portion positioned between the short end and the open end of the non-feed radiation electrode;

a first capacitance-loading conductor that extends from the capacitance-loading portion toward the short end of the non-feed radiation electrode; and a second capacitance-loading conductor that extends from the short end of the non-feed radiation electrode toward the capacitance-loading portion, wherein a capacitance for adjusting the resonant frequency in the fundamental mode is formed between the first capacitance-loading conductor and the second capacitance-loading conductor.

19. The antenna structure according to claim 15, wherein the antenna structure is provided on a board including a ground.

20. The antenna structure according to claim 15, further comprising a board having a ground region and a non-ground region, and at least part of the antenna structure is provided in the non-ground region of the board.

21. The antenna structure according to claim 20, wherein the at least part of the antenna structure protrudes outside the board from the non-ground region.

22. An antenna structure comprising:

a circuit for radio communication;

a dielectric base member;

a feed radiation electrode provided on the dielectric base member and connected to the circuit for radio communication;

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion located between the short end and the open end of the non-feed radiation electrode; and a capacitance-loading conductor that extends from the capacitance-loading portion in a direction toward the short end, the capacitance-loading conductor forming a capacitance for adjusting the resonant frequency in the fundamental mode between the short end of the non-feed radiation electrode and the capacitance-loading portion.

23. The antenna structure according to claim 22, wherein the antenna structure is provided on a board including a ground.

24. The antenna structure according to claim 22, further comprising a board having a ground region and a non-ground region, and at least part of the antenna structure is provided in the non-ground region of the board.

25. The antenna structure according to claim 24, wherein the at least part of the antenna structure protrudes outside the board from the non-ground region.

26. An antenna structure comprising:

a circuit for radio communication;

a dielectric base member;

a feed radiation electrode provided on the dielectric base member and connected to the circuit for radio communication;

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance-loading portion positioned between the short end and the open end of the non-feed radiation electrode; and a capacitance-loading conductor that extends from the short end of the non-feed radiation electrode in a direction toward the capacitance-loading portion, the capacitance-loading conductor forming a capacitance for adjusting the resonant frequency in the fundamental mode between the short end of the non-feed radiation electrode and the capacitance-loading portion.

27. The antenna structure according to claim 26, wherein the antenna structure is provided on a board including a ground.

28. The antenna structure according to claim 26, further comprising a board having a ground region and a non-ground region, and at least part of the antenna structure is provided in the non-ground region of the board.

29. The antenna structure according to claim 28, wherein the at least part of the antenna structure protrudes outside the board from the non-ground region.

30. An antenna structure comprising:

a circuit for radio communication;

a dielectric base member;

a feed radiation electrode provided on the dielectric base member and connected to the circuit for radio communication;

a non-feed radiation electrode provided on the dielectric base member, the non-feed radiation electrode spaced from and electromagnetically coupled to the feed radiation electrode to produce a multiple-resonance state, the non-feed radiation electrode performing an antenna operation in a fundamental mode with a lowest resonant frequency among a plurality of resonant frequencies of the electrode and an antenna operation in a higher-order mode with a resonant frequency higher than the resonant frequency in the fundamental mode, wherein:

the non-feed radiation electrode has a spiral shape such that the feed radiation electrode extends in a direction away from a conduction point connected to a ground and then turns to approach the conduction point, a first end of the non-feed radiation electrode defining a short end grounded via the conduction point to the ground, and a second end of the non-feed radiation electrode defining an open end;

a capacitance loading portion positioned between the short end and the open end of the non-feed radiation electrode;

a first capacitance-loading conductor that extends from the capacitance-loading portion toward the short end of the non-feed radiation electrode; and a second capacitance-loading conductor that extends from the short end of the non-feed radiation electrode toward the capacitance-loading portion, wherein a capacitance for adjusting the resonant frequency in the fundamental mode is formed between the first capacitance-loading conductor and the second capacitance-loading conductor.

31. The antenna structure according to claim 30, wherein the antenna structure is provided on a board including a ground.

32. The antenna structure according to claim 30, further comprising a board having a ground region and a non-ground region, and at least part of the antenna structure is provided in the non-ground region of the board.

33. The antenna structure according to claim 32, wherein the at least part of the antenna structure protrudes outside the board from the non-ground region.

* * * * *